US006572340B2

(12) United States Patent
Collins

(10) Patent No.: US 6,572,340 B2
(45) Date of Patent: Jun. 3, 2003

(54) PRESSURE MOTIVE PUMP ASSEMBLY COMPRISING A FLOAT, AN OVER CENTER LINKAGE MECHANISM, AND A PAIR OF POSITIVE STOP OR ABUTMENT MEANS FOR ENSURING OVER CENTER TRIPPING ACTION

(76) Inventor: Robert Collins, P.O. Box 143, Spring Mount, PA (US) 19478

( * ) Notice: Subject to any disclaimer, the term of this patent is extended or adjusted under 35 U.S.C. 154(b) by 0 days.

(21) Appl. No.: 09/931,448

(22) Filed: Aug. 16, 2001

(65) Prior Publication Data

US 2002/0041808 A1 Apr. 11, 2002

Related U.S. Application Data

(60) Provisional application No. 60/237,586, filed on Oct. 3, 2000.

(51) Int. Cl.[7] ..... F04F 1/06

(52) U.S. Cl. ..... 417/133; 417/130; 417/131; 417/134

(58) Field of Search ..... 417/130, 131, 417/133, 134

(56) References Cited

U.S. PATENT DOCUMENTS 6,099,260 A * 8/2000 Reynolds ..... 417/126

OTHER PUBLICATIONS

Armstrong, The Armstrong Pumping Trap, Nov./1997, Armstrong Fluid Handling Inc., Bulletin No. 230–C 15M, pp. 3 and 5.*

* cited by examiner

*Primary Examiner*—Charles G. Freay
*Assistant Examiner*—Emmanuel Sayoc

(57) ABSTRACT

A motive pump assembly comprising a hollow housing having an inlet valve and outlet valve for a fluid to be pumped, an inlet valve for a motive fluid operatively between open and closed positions, a vent valve and means for simultaneously opening and closing the inlet valve and vent valve for the motive fluid, and a float and over center linkage mechanism operatively connected to said valve actuating means, whereby the mechanism snaps over center when the float is located at upper and lower limit positions thereby producing a pumping action of fluid to be pumped through the housing and positive stop means ensuring over center tripping action of the linkage when the float is at opposing upper and lower limit positions.

3 Claims, 7 Drawing Sheets

74
72
64
80
66
62
70

46
42
46
20
24
3A
11

PRESSURE MOTIVE PUMP ASSEMBLY COMPRISING A FLOAT, AN OVER CENTER LINKAGE MECHANISM, AND A PAIR OF POSITIVE STOP OR ABUTMENT MEANS FOR ENSURING OVER CENTER TRIPPING ACTION

This application claims the benefit of U.S. Provisional Application No. 60/237,586 filed Oct. 3, 2000.

BACKGROUND OF THE INVENTION

The present invention relates to improvements in pump assemblies and more specifically to improvements in secondary pressure drainers.

SUMMARY OF THE INVENTION

Pumps of the type to which the present invention relate generally are not newer se. Pressure motive pumps, generically known as secondary pressure drainers, are typically used to move steam condensate at or near saturation temperature. Centrifugal pumps do not perform well pumping liquids at saturation temperature because the pressure reduction at the pump inlet causes a fraction of the liquid to vaporize. The resulting two phase mixture reduces pumping capacity and causes severe wear on the pump's rotating components.

These devices are also used in pumping applications where arc-over sparks may ignite a volatile fluid and where the use of electrical motors or the like may be hazardous. They are also used in remote hard-to-get-at locations or areas.

These pumps are generally used when it is desired to move liquids to a higher elevation, higher pressure or great distances. Some applications include steam condensate from vacuum or low pressure systems, condensate systems with high back pressure, steam condensing equipment such as heat exchangers, condensers or turbines, remote installations such as tank farms and as indicated above, in applications where electricity is prohibited, such as underground steam distribution systems.

Broadly speaking, the pump utilizes a spring-loaded mechanism inside a pump body to control liquid removal when the pump starts to fill through an inlet check valve where a float in the housing is in a low level position, which as described in more detail hereafter, opens a vent valve and closes the motive gas supply valves. When the spring-loaded mechanism reaches the trip point and snaps over center, the vent valve closes and the gas supply valve opens simultaneously. As the liquid is pumped out through the outlet check valve, the float starts to drop. When the float reaches the switch point, the mechanism snaps over center, the gas supply valve closes and the vent opens allowing the filling process to repeat. This is a continuous, repetitive process for pumping fluids and the like. In accordance with the present invention, means are provided for ensuring repetitive operation of the spring-loaded mechanism over long periods of time even where erosion of some of the parts and friction between the parts tend to deter normal operation of the pump.

In a typical cycle of operation, when the tank is starting to fill with a liquid such as steam condensate through the inlet port, the float is in the down position opening a vent valve to expel working gas, so condensate can enter the tank. As the condensate fills the tank to a certain point, the float rises and shuts off the vent valve and opens the inlet valve for the working gas. The working gas, such as steam or air discharges the condensate out the outlet port. As the condensate flows out, the float returns to its down position and the cycle starts over. It is noted that the inlet port is a check valve which allows only the flow of gasoline into the tank. The outlet port is also a check valve which prevents the pumped fluid from flowing back into the pump body.

BRIEF DESCRIPTION OF THE DRAWINGS

These and other objects of the present invention and various features and details of the operation and construction thereof are hereinafter more fully set forth with reference to the accompanying drawings, wherein.

DETAILED DESCRIPTION OF THE PREFERRED EMBODIMENTS

Figure 1:
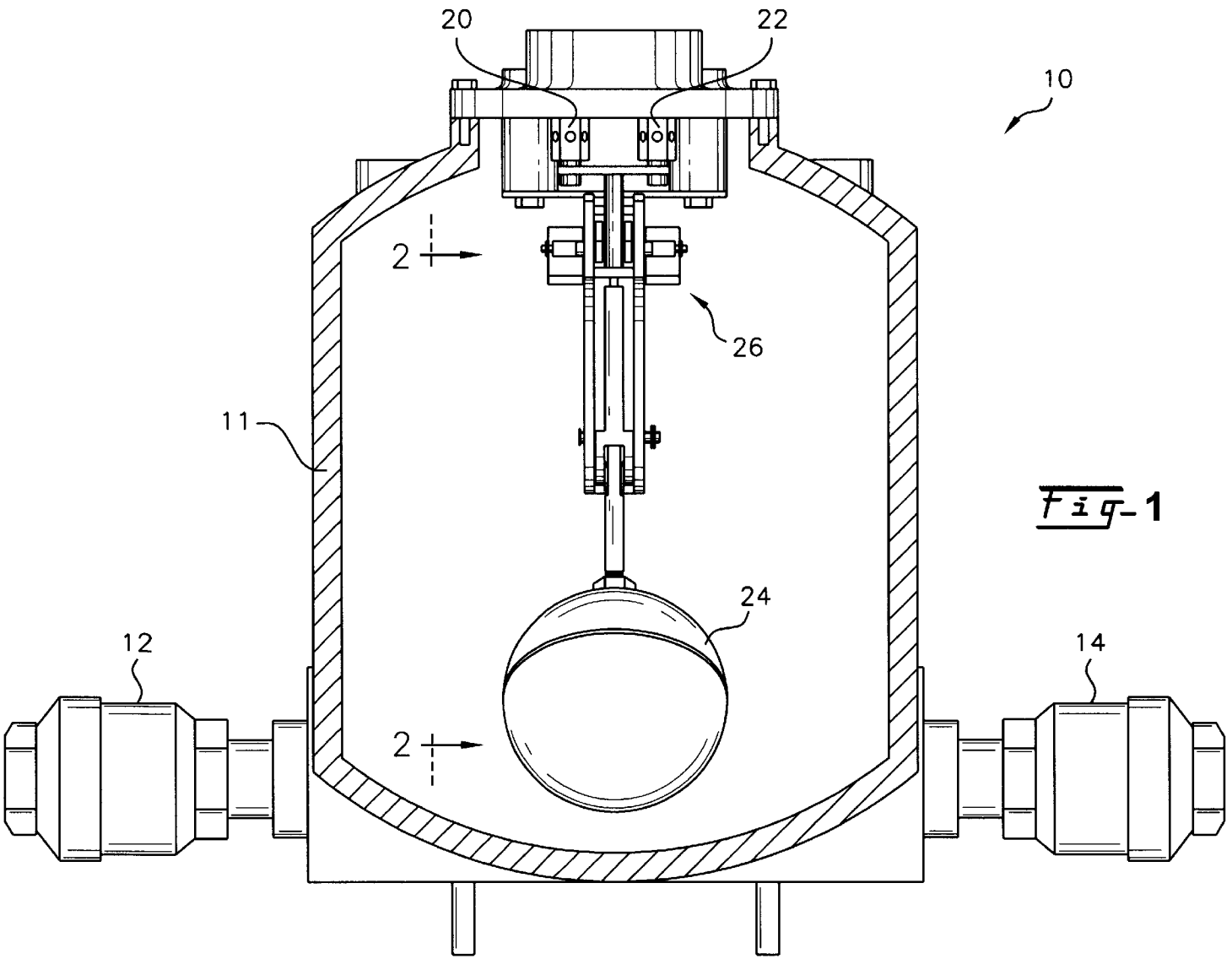
FIG. 1 is a front elevational view partially in section of a pressure motive pump in accordance with the present invention.

Referring now to the drawings and particularly to FIG. 1 thereof, there is shown a secondary pressure drainer generally designated by the numeral 10 incorporating the improvements of the present invention. The drainer assembly 10 of the present invention functions to move or transport liquids in applications where electric motors would not be suitable for pumping liquids at or close to saturation temperature. For example, in some applications, arc-over sparks may ignite a volatile fluid. In other instances, electricity is either prohibited or the pump requirements are in a remote location or one that is inaccessible to provide electrical power.

Considering first the main components of the pump and the overall operation thereof, the pump comprises a generally cylindrical hollow housing 11 having at its lower end an inlet valve 12 for the fluid to be pumped, for example, a petroleum product and an outlet valve 14 for discharge of the fluid to be pumped. The inlet valve 12 is a check valve which allows flow of fluid into the housing and prevents flow out. The outlet valve 14 is also a one-way valve allowing flow out. The system also includes an inlet valve 20 connected to a suitable supply for a motive gas such as steam or air and a vent valve 22 for venting the motive fluid in the manner described below. A float 24 is operatively connected to inlet valve 20 and vent valve 22 by a spring loaded over center mechanism generally designated by the numeral 26.

Figure 2:
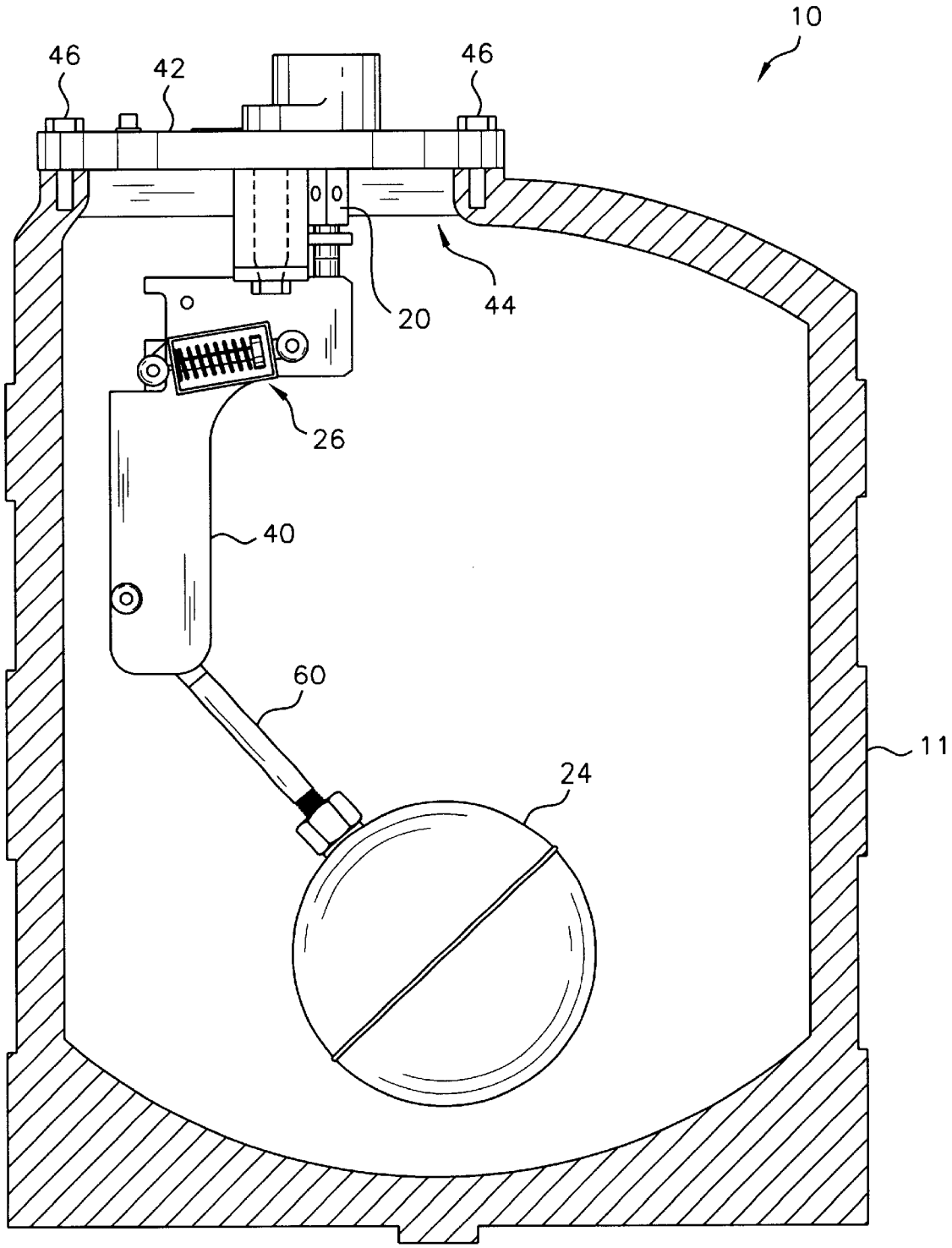
FIG. 2 is a side elevational view partially in section of the present invention.

Consider now the operational cycle of a secondary pressure drain pump assembly as described. The fluid to be pumped enters the housing through the inlet check valve 12. In the initial filling, the float 24 is in the low level position (see FIG. 2) which opens the vent valve 22 and closes the motive gas supply valve 20. As the level of fluid to be pumped rises in the housing 11, the float 24 rises to the position shown in solid lines in FIG. 3 and when the spring loaded over center mechanism 26 reaches an upper trip point (see FIG. 7), the vent valve 22 closes and simultaneously the motive gas supply valve 20 opens (see FIG. 8). The build up in motive gas pressure effects discharge of the fluid to be pumped through the outlet discharge valve 14 and as the liquid in the housing is pumped out through this valve, the float 24 starts to drop. When the float 24 reaches the lower limit position or switch point (see FIG. 6), the mechanism 26 snaps over center (FIG. 5) and closes the gas supply valve 20 and simultaneously opens the vent valve 22 allowing the filling cycle or process to repeat.

Figure 4:
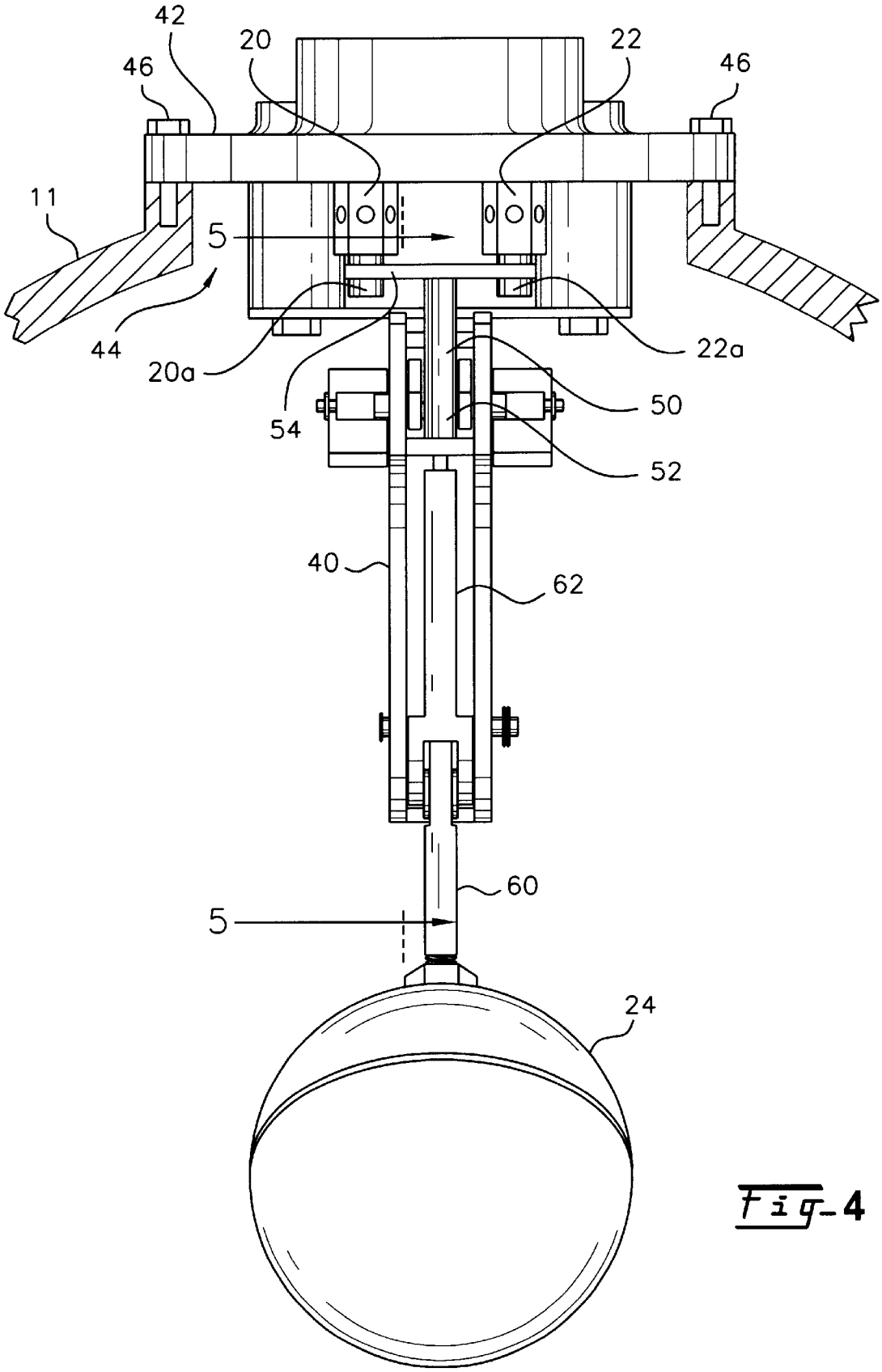
FIG. 4 is a partial view of the pressure motive pump.
Figures 5, 5A:
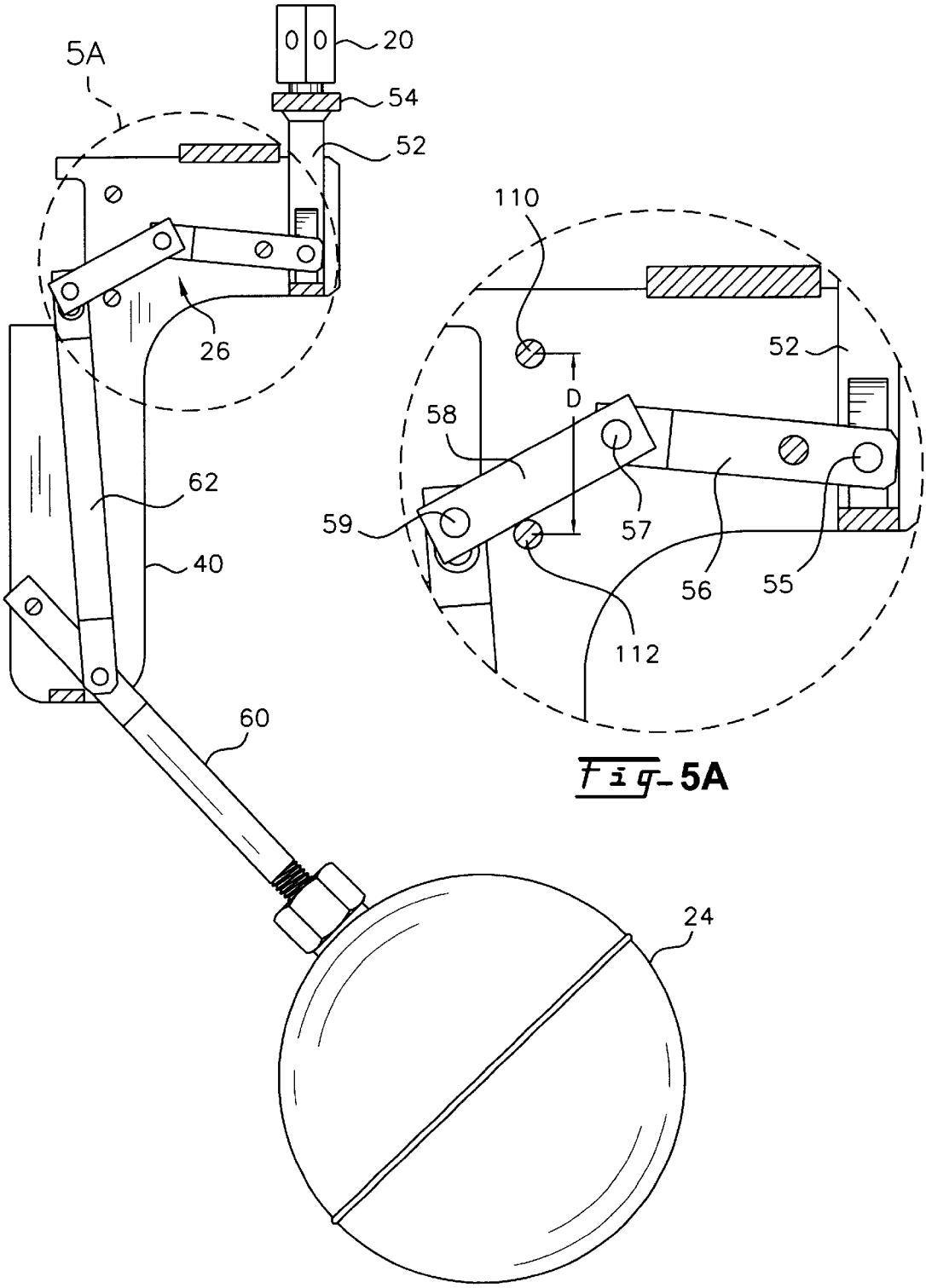
FIG. 5 is a view taken along lines 5—5 of FIG. 4.
FIG. 5A is an enlarged view of the linkage mechanism of the pressure motive pump shown in broken lines in FIG. 5.

Considering now the secondary pressure drainer assembly in more detail the over center mechanism 26 and the float 24 are mounted in a yoke support 40 depending from a cover 42 of generally circular configuration closing an opening 44 in the top of the housing 11. The cover 42 as shown is removably held in place by a series of bolts 46. As best illustrated in FIGS. 4, 5 and 5A, a T-bar 50 comprising an elongated rod 52 and a cross piece 54 is pivotably connected as at 55 to one of the links 56 of the over center linkage 26. The cross piece 54 of the T-bar 50 is operatively connected at its outer ends to the plungers 20*a*, 22*a* of the gas supply valve 20 and vent valve 22.

Figures 3, 3A:
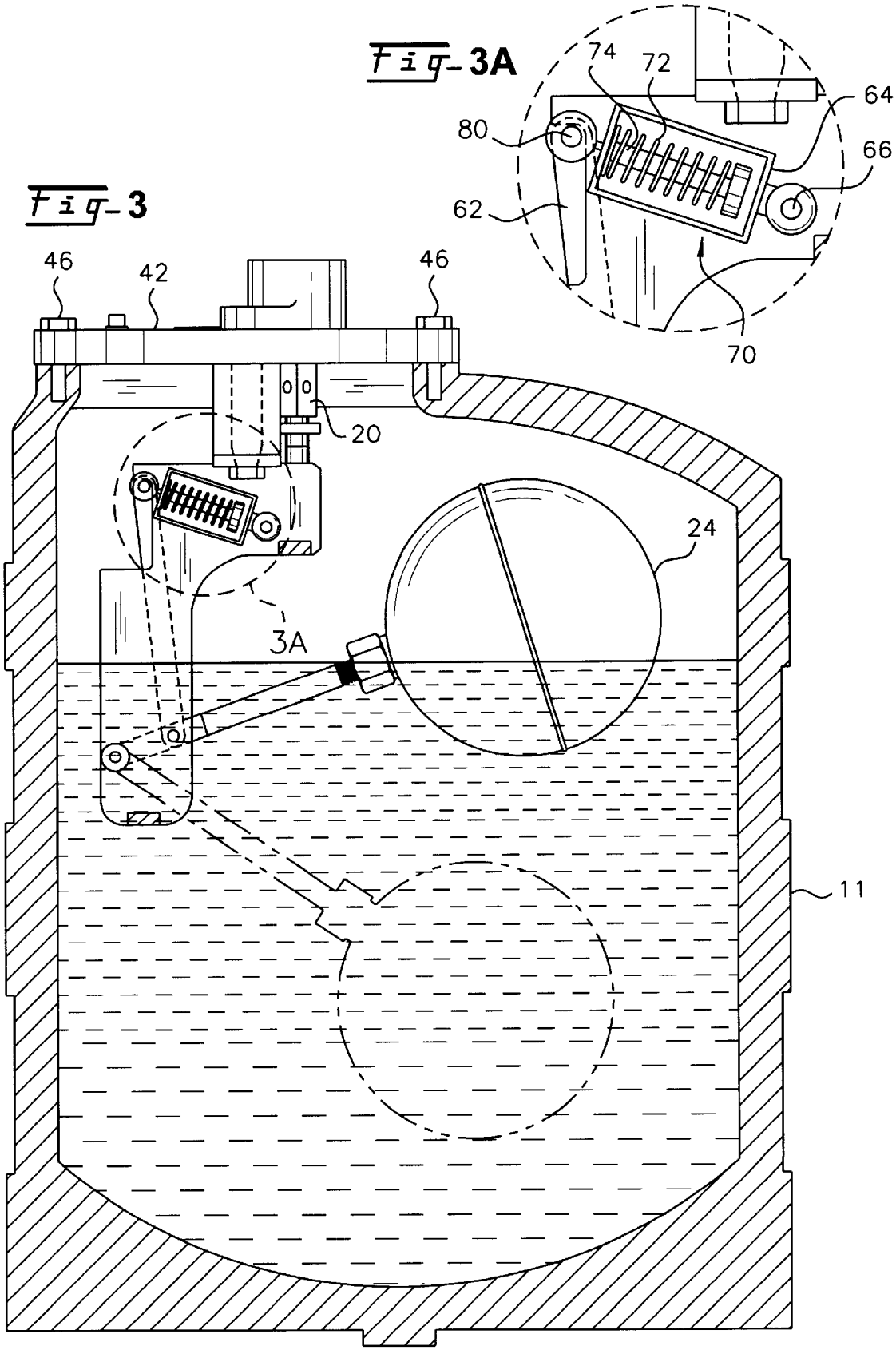
FIG. 3 is a transverse sectional view of a pressure motive pump assembly incorporating the present invention.
FIG. 3A is an enlarged view of the spring assembly of the pressure motive pump shown in broken lines in FIG. 3.
Figure 6:
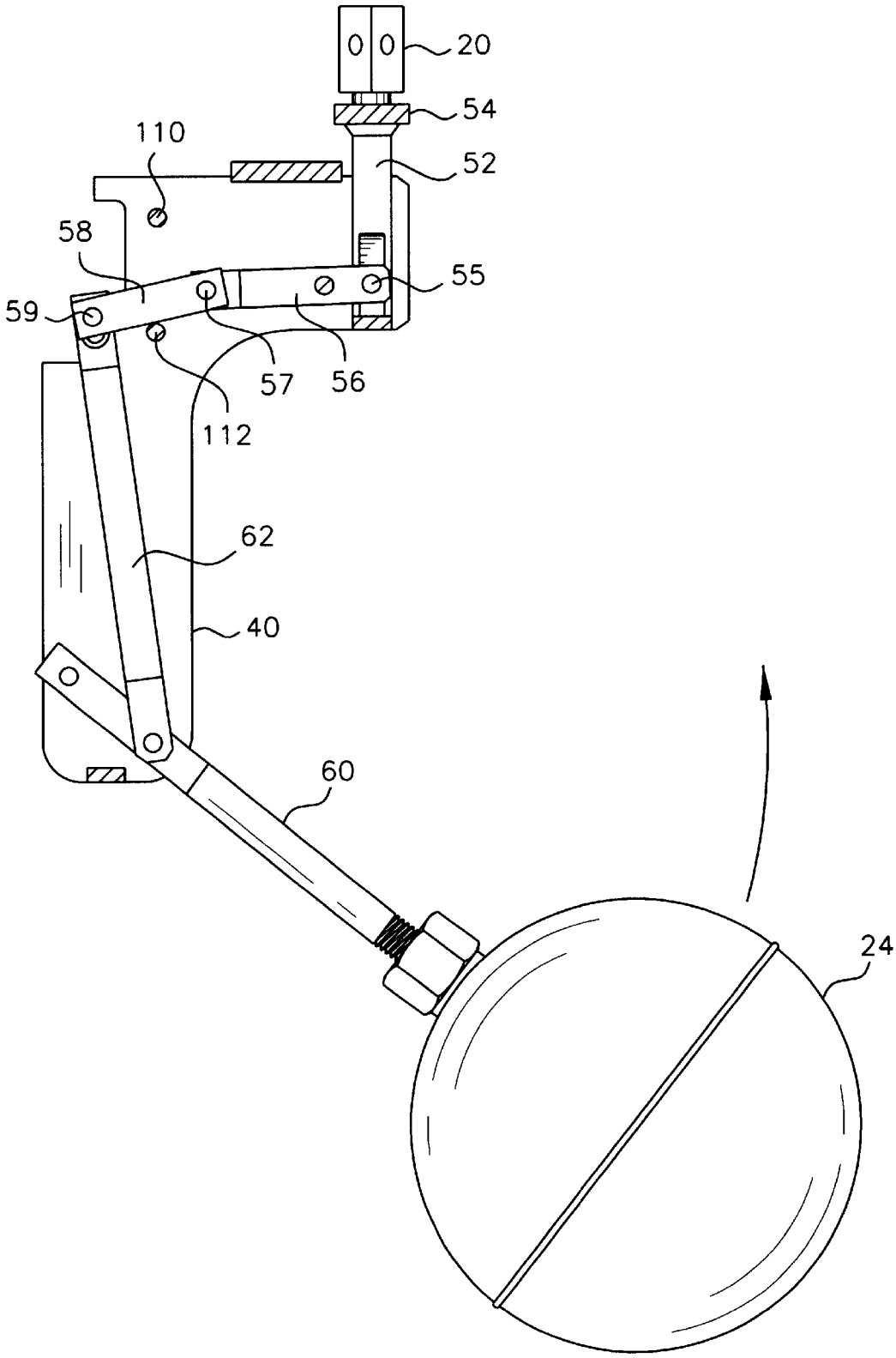
FIG. 6 is another view of the linkage mechanism at a trip position.
Figure 7:
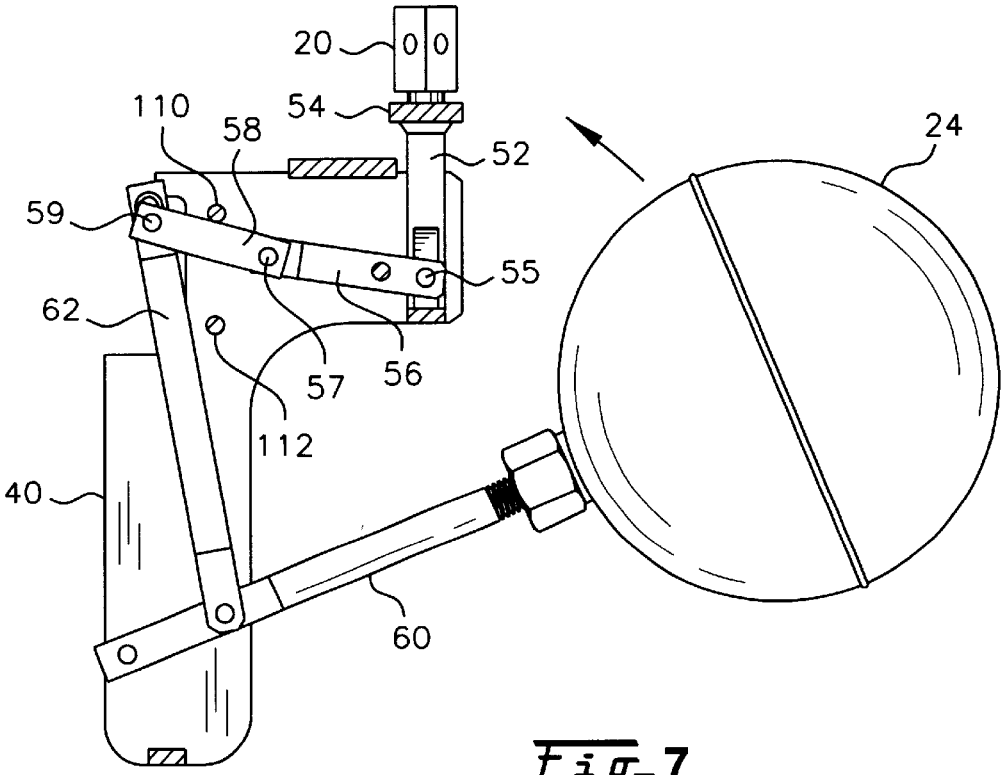
FIG. 7 is a view similar to FIG. 6 showing the linkage at the trip point.

The float 24 is mounted on the outer end of an elongated arm 60 which is pivotally connected at its inner end to the yoke 40 as at 62. A spring link 62 connects the float arm 60 to the spring assembly 70 and the over center links 56 and 58 of the over center mechanism 26. The spring assembly 70 as best illustrated in FIGS. 3 and 3A comprises an open housing 64 pivotally connected on opposing sides of a leg of the yoke as at 66. Each spring assembly 70 includes a compression spring 72 and a rod 74. The rod 74 protrudes through the bottom of the housing 64. The rods 74 of the spring assemblies are connected by a connecting member 80 to the spring link 62 and one of the two over center links 56 and 58. As best illustrated in FIGS. 5, 5*a* and 6, the over center links 56 and 58 are pivotally connected to one another as at 57 and to the spring link as at 59 and to the T-bar as at 55. By this arrangement, as the float 24 moves between upper and lower positions, the linkages articulate and pivot relative to one another in the manner shown in FIGS. 5, 5*a*, 6 and 8.

It has been found that over a period of use, the joints and pivot points erode due, for example, to the corrosive effect of the environment. Additionally, impurities in the liquid can collect in the clearances between the mating links and/or pins which increases friction such that the buoyant force is insufficient to lift the float. If the float becomes totally submerged, the pump fails to operate. The pump body will completely flood. Liquid will flow from the vent valve. Increased friction forces can also exceed the ability of the float to drop during the pump discharge portion of the cycle. In this case, the motive gas discharges all of the fluid out of the pump and then continues to expel the motive gas into the downstream piping causing other equipment to potentially stop working.

Figure 8:
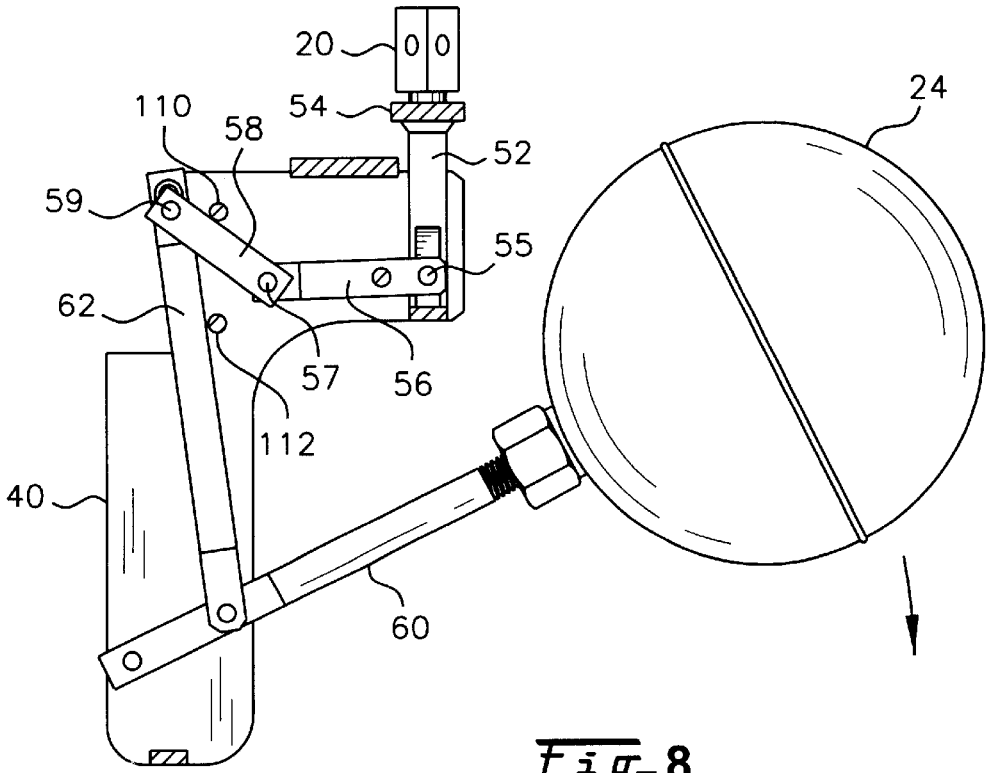
FIG. 8 is a view similar to FIGS. 6 and 7 showing the linkage after tripping.

In view of the above, there is provided with a pair of stops in the form of pins 110, 112 disposed at a predetermined distance D from one another between the yoke elements 40 and in the pivot path of the over center linkage mechanism 26. As shown in FIGS. 5 and 8, the link 58 engages these pins when the float is near its extreme limit positions and ensures the over center action activates the valves 20 and 22 in the manner indicated above to produce the repeat cycles for pumping fluid in the manner described. Thus, the pins 110, 112 provide an alternate pivot point ensuring a snap-over action to reverse the valves 20 and 22 during this part of the cycle. The link engages the upper pin 110 when the float is near its upper limit position and ensures snap-over action to reverse the valves.

In summary, normal wear of the parts, friction between the parts and the corrosive action on the joints particularly the over center joint effects the over center action and reversal of the valves necessary to produce the pumping action. The present invention ensures normal over center action despite the normal deleterious effects of wear, friction and corrosion.

Even though particular embodiments of the present invention have been illustrated and described herein, it is not intended to limit the invention and changes and modifications may be made therein within the scope of the following claims.

What is claimed is:

1. A pump assembly comprising:

a hollow housing (11) having a first inlet valve (12) and outlet valve (14) for a fluid to be pumped;

a second inlet valve (20) for a motive fluid operative between open and closed positions and a vent valve (22) and a value actuating means for simultaneously opening and closing said second inlet valve (20) and vent valve (22) for the motive fluid:

a float (24), an over center linkage mechanism (58) operatively connected to said valve actuating means comprising a pair of links (56), (58) pivotally connected to one another and to said float (24) and to said second inlet (20) and said vent (22);

and positive stop means engageable by one of said over center links ensuring over center tripping action of the linkage when the float Is at opposing upper and lower limit positions.

2. A pump assembly comprising:

a hollow housing (11) having a first inlet valve (12) and outlet valve (14) for a fluid to be pumped;

a second inlet valve (20) for a motive fluid operative between open and closed positions and a vent valve (22) and means for simultaneously opening and closing said second inlet valve (20) and vent valve (22) for the motive fluid;

a float (24), an over canter linkage mechanism (55) operatively connected to said valve actuating a value actuating means comprising a pair of links (58), (58) pivotally connected to one another and to said float (24) and to said second inlet (20) and said vent (22);

over center linkage mechanism operatively connected to said valve actuating means comprising a pair of spaced abutments defining alternate pivot points engageable by one of said over center links ensuring aver center tripping action of the linkage when the float is at opposing upper and lower limit positions.

3. A pump assembly comprising:

a hollow housing (11) having a first inlet valve (12) and outlet valve (14) for a fluid to be pumped;

a second inlet valve (20) for a motive fluid operative between open and close positions and a vent valve (22) and a value actuiating means for simultaneously opening and closing said second inlet valve (20) and vent valve (22) for the motive fluids;

a float (24);

a T-bar (52) mounting plungers for simultaneously opening and closing said motive gas supply valve (20) and vent valve (22) for controlling flow of motive fluid in the housing;

a yolk (40) mounted in the housing;

a float (24) having an arm (60) pivotally connected to the yolk (40); and an over center linkage mechanism comprising a pair of links (56), (58) pivotally connected to one another and pivotally connected to the T-bar (52);

a spring link (62) connecting the pair of links (56), (58) to the float arm (60); and a pair of spaced abutments (110), (112) defining alternate pivot points ensuring over center tripping action of the over center linkage when the float (24) is at opposing upper and lower limit positions.

* * * * *